United States Patent [19]

Seeley et al.

[11] Patent Number: 4,993,135

[45] Date of Patent: Feb. 19, 1991

[54] HEAVY DUTY CLIPPER

[75] Inventors: David Seeley, Ashville; Ray Hutley, Stow, both of N.Y.

[73] Assignee: Delaware Capital Formation, Inc., Apex, N.C.

[21] Appl. No.: 378,903

[22] Filed: Jul. 12, 1989

[51] Int. Cl.[5] ..... B23P 11/00; B23P 19/04; B65B 51/04

[52] U.S. Cl. ..... 29/243.56; 53/138 A; 227/120

[58] Field of Search ..... 29/253.56; 53/138 R, 53/138 A; 227/120, 156

[56] References Cited

U.S. PATENT DOCUMENTS

| | | | |
|---|---|---|---|
| 3,783,583 | 1/1974 | Dobbert | 53/138 A |
| 3,810,292 | 5/1974 | Whales | 53/138 A X |
| 3,940,841 | 3/1976 | Velarde et al. | 29/243.56 |
| 4,004,339 | 1/1977 | Velarde | 29/293.56 |
| 4,083,164 | 4/1978 | Hagedorn | 29/243.56 X |
| 4,312,108 | 1/1982 | Tipper | 29/243.56 X |
| 4,458,402 | 7/1984 | Evans et al. | 29/243.56 |
| 4,642,865 | 2/1987 | Kelem | 53/138 A X |
| 4,766,713 | 8/1988 | Evans | 53/138 A |
| 4,807,345 | 2/1989 | Jacobson | 29/243.56 |
| 4,827,591 | 5/1989 | Arnone | 29/243.56 |

*Primary Examiner*—Paul A. Bell

*Attorney, Agent, or Firm*—Allegretti & Witcoff, Ltd.

[57] ABSTRACT

An improved heavy duty clipper utilizes a punch and gathering bar both driven down parallel channels simultaneously following manual closure of a pivot gate and locking of that gate in the closed position by means of a locking hook.

8 Claims, 4 Drawing Sheets

HEAVY DUTY CLIPPER

BACKGROUND OF THE INVENTION

This invention relates to an improved clipper apparatus and, more particularly, to an apparatus useful for the attachment of U-shaped metal clips about a large mass of gathered material.

Packaging of solid powder materials in a tubular elongate package has been a technique utilized for packaging of blasting powder used in mining operations. Typically the package is an elongated, cylindrical tube of canvas, cloth, patper or plastic sewn or sealed at its opposite ends. The elongated cylindrical powder filled package may be lowered in to a hole drilled in the earth and then ignited. Handling of such packages and packing of the packages particularly using sewing techniques or other closure techniques for such packages has long been a problem. Improved methods of sealing such packages has been desired.

The material used for such packaging is usually a thick, multiple layer sheet comprised, for example, of fibers, plastics, paper and the like in various forms and combinations. When sealing the end of such package, the massive material that must be contained by a closure of fasteners is significant and requires significant energy.

In U.S. Pat. No. 3,940,841 issued Mar. 2, 1976 for a Clipper Apparatus For Attaching Material To A Broomstick Or The Like, there is disclosed a device for attaching a metal clip about a large diameter segment or section of gathered material. Although the closure disclosed therein might be useful for heavy duty packaging, the clipper disclosed would not be practical. Thus there has remained a need for improved apparatus which is cable of receiving a large mass of material, for gathering that material easily, and for applying a large U-shaped metal clip about that material to seal the closure tightly in a single simple operation.

SUMMARY OF THE INVENTION

In a principal aspect the present invention comprises an apparatus for attaching a clip about a large mass of gathered material. The clip is a U-shaped metal clip comprised of a pair of space, opposed, parallel legs connected by a crown, the spacing of the legs significant on the order of one inch or more. The apparatus comprises a clipper which is supported on a stand. Specifically, a carriage is mounted on the stand with a hydraulic punch drive cylinder supported by the carriage for driving a punch down a channel to force a clip in the channel toward a die. A manually operable gate is provided to close an open throat of the punch channel. The manual gate is cooperative with a locking hook number to maintain the gate in the closed position during the clip attachment operation. Cooperative and moveable simultaneously with the punch and also driven by the punch drive cylinder is a gathering bar. The gathering bar has a special, shaped end to engage the gathered material and compress the material in a manner that prevents the clip from tearing the material during the clip attachment operation. The clip apparatus includes safety features which require the use of at least two clip operating signals in order to effect operation of the clipper.

Thus it is an object of the present invention to provide an improved heavy duty clipper apparatus.

It is a further object of the invention to provide an improved clipping apparatus which may be used to attach a U-shaped metal clip having widely space leg about a thick mass of gathered material.

Yet a further object of the present invention is to provide an improved clipper apparatus which permits attachment of a large U-shaped metal clip about a gathered mass of a material without damage to that gathered mass of material.

A further object of the present invention is to provide a clipper apparatus used for attaching heavy duty clips in a way which is economical, efficient and safe.

Yet another object of the invention is to provide an improved heavy duty clipper apparatus having fewer parts and which operates at high pressures associated with hydraulic operation in an efficient manner.

These and other objects, advantages and features of the invention will be set forth in the detailed description which follows.

BRIEF DESCRIPTION OF THE DRAWING

In the detailed description which follows reference will be made to the drawing comprised of the following figures.

DESCRIPTION OF THE PREFERRED EMBODIMENT

Figure 1:
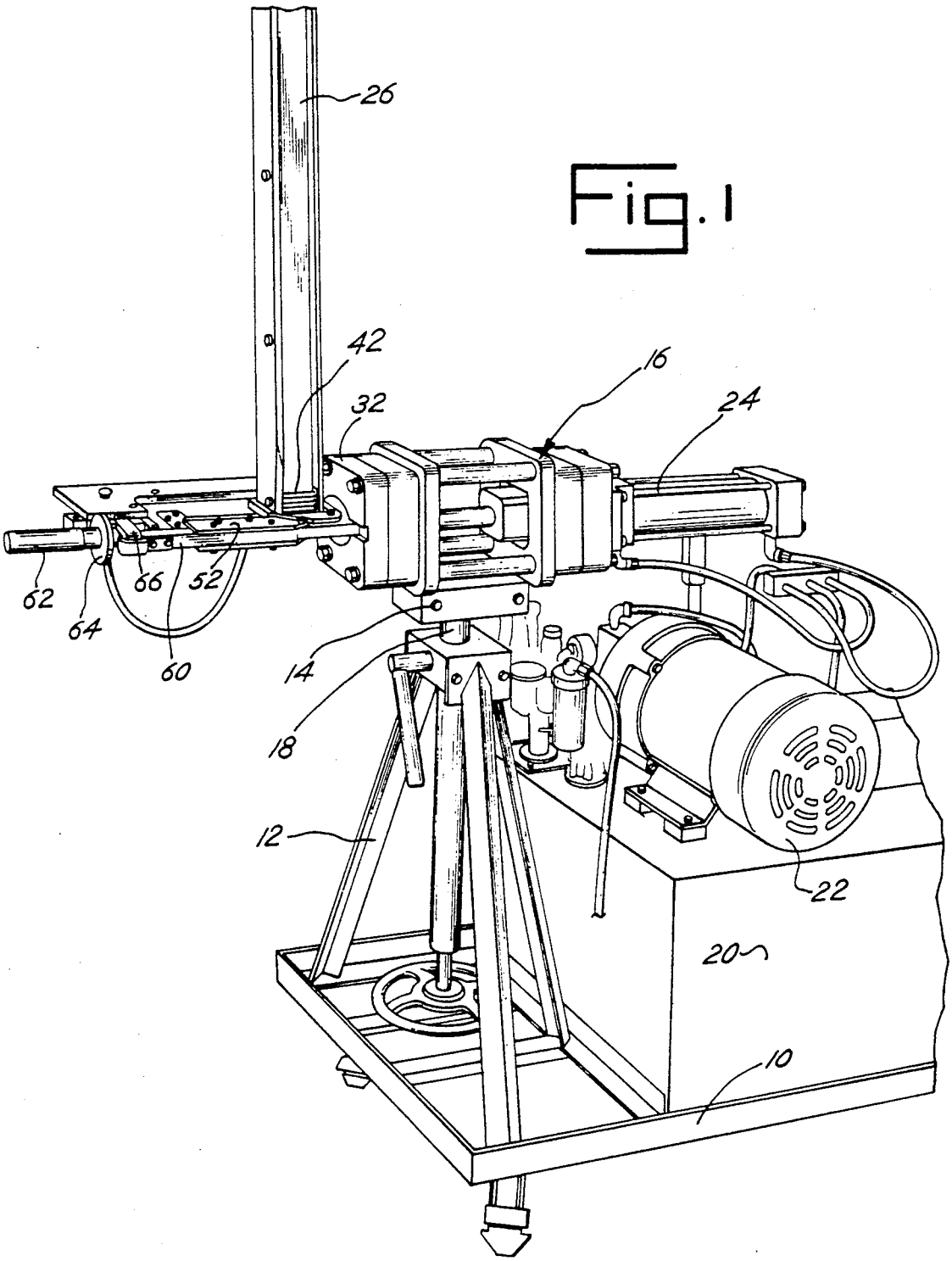
FIG. 1 is a perspective view of the improved heavy duty clipper of the invention.

Referring to the figures and in particular FIG. 1, there is depicted an overall view of the improved heavy duty clipper apparatus of the present invention. A clipper is mounted on a frame 10 which is supported by casters 11 so that the clipper can be easily moved from one station to another. The frame 10 includes a tripod 12 which supports a plate 14 upon which a carriage 16 is fastened. The plate 14 is supported by a shaft or rod 18 mounted in the tripod 12. The height of the plate 14 is thus adjustable by vertical movement of the rod 18 in the tripod 12. Additionally the plate 14 is pivotal about the axis of the rod at 18 again facilitating portioning of the Clipper apparatus for a packaging operation.

Supported on the frame 10 is a reservoir 20 for hydraulic fluid and an electric motor and hydraulic pump assembly 22 which provides hydraulic pressure for operation hydraulic cylinder 24 which is part of the main clipper apparatus. Appropriate control lines, filters, regulators, interconnecting hydraulic lines and the like are provided for providing controlled hydraulic fluid pressure to the hydraulic cylinder 24 to operate a hydraulic, double acting piston associated with the hydraulic cylinder 24. The device is preferably operated by means of a hydraulic cylinder 24 inasmuch as the hydraulic cylinder 24 will provide higher pressure operation to the punch of that clipper apparatus. Additionally highly sensitive control is possible with such a cylinder 24.

The carriage 16 which is supported on the plate 14 supports the hydraulic cylinder 24 at one end thereof and supports the remainder of the clipper mechanism at the opposite end thereof. Clips are fed down a clip rail 26 into a window (not shown in FIG. 1) for engagement by a punch 44 for attachment about the closed end of a package. FIGS. 2 through 7 illustrate in greater detail the specific construction of the remainder of the clipper apparatus.

Figure 2:
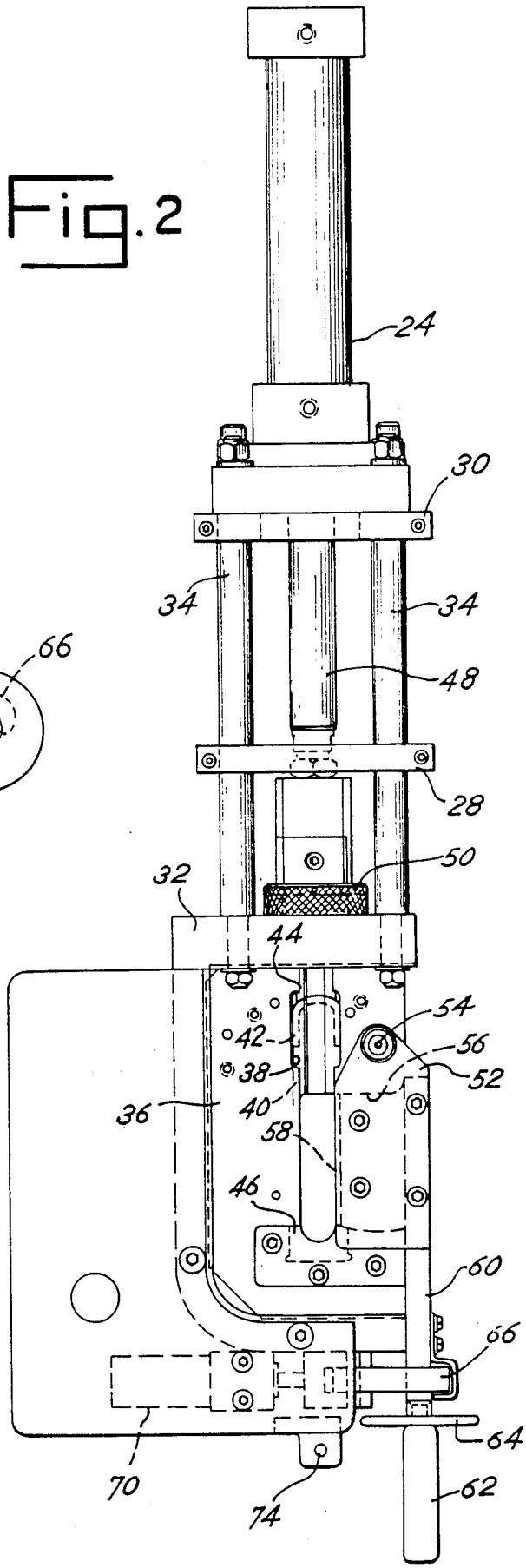
FIG. 2 is a top plan view of the clip carriage and hydraulic cylinder of the clipper apparatus depicted in FIG. 1.
Figure 3:
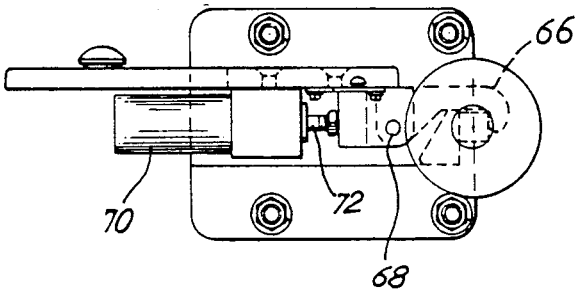
FIG. 3 is an end view of the carriage shown in FIG. 2.

Referring first therefore to FIG. 2 the carriage 16 is comprised of first and second spaced plates 28 and 30 which are generally parallel and cooperative with yet with a third parallel spaced plate 32. All of the plates 28, 30 and 32 are fastened together means of tie-rods 34. The hydraulic cylinder 24 is mounted at one end of the assembly attached to the plate 30 by means of tie-rods 34. At the opposite end of the assembly a main clipper plate 36 is attached to the plate 32. The clipper plate 36 defines a clip window 38 and a clip channel 40.

A U-shaped metal clip 42 which is shown in phantom in FIG. 2 may be fitted down the rail 26 and into the window 38 where clip 42 would be engaged by a punch 44 and driven down the channel 40. In this manner the clip 42 engage a die 46 retained at the end of the channel 40 for forming the clip 42 as a closure about gathered material. This general construction is known to those of skill in the art. The punch 44 is driven by the rod 48 associated with the hydraulic cylinder 24. The cylinder 24 drives the rod 48 reciprocally. An adjustable stop or limit 50 is provided with respect to the rod 48 to limit the travel of the rod and thus the travel of punch 44 toward the die 46.

Among the novel features of the invention is the construction of a gate 52 which is pivotally attached to the plate 36 by means of a pivot pin 54 positioned on the plate 36 opposite the die 46. Die 46 is retained in the plate 36. Thus the pivot pin 54 is positioned on the side of the punch 44 adjacent the opening of 56 in the plate 36. The opening 56 thus defines an open throat which can be closed by means of the gate 52 pivoting about the pin 54. The gate 52 includes a channel extension 58, as shown in FIG. 2, for receipt and guiding of the clip 42 against the die 46 when the gate 52 is pivoted to the closed position as illustrated in FIG. 2. The gate 52 includes a manual handle assembly 60 which extends radially generally from the pivot pin 54 and terminates with a manual handle 62 having a protective shield 64 at the inner end of the handle 62 to prevent slippage of the hand of an operator toward the pin or gate 52. This shield 64 is desired inasmuch as the extension 60 cooperates with a hook 66 which is pivotally mounted on the plate 36 for pivoting about a pin 68 in response to actuation of a pneumatic cylinder 70 also mounted on the plate 36. The cylinder 70 includes an extendable rod 72 which drives the hook 66 into and out of engagement with the extension 60 to lock or unlock the gate 52 in the position illustrated in FIG. 2. Operation of the cylinder 70 is effected by means of a thumb valve 74 and a foot treadle valve 75. The thumb valve 74 is mounted adjacent the handle 62 so that an operator may grip the handle 62 and operate the thumb valve 74 with the same hand. The thumb valve 74 and foot treadle 75 are depressed substantially simultaneously. The operators hand operating the valve 74 is protected from sliding into engagement with the hook 66 by the shield 64. In operation both the thumb valve 74 and foot treadle 75 must be substantially simultaneously operated in order to effect operation of both hook 66 and sequentially the cylinder 24 to thereby drive the punch 44.

Figure 7:
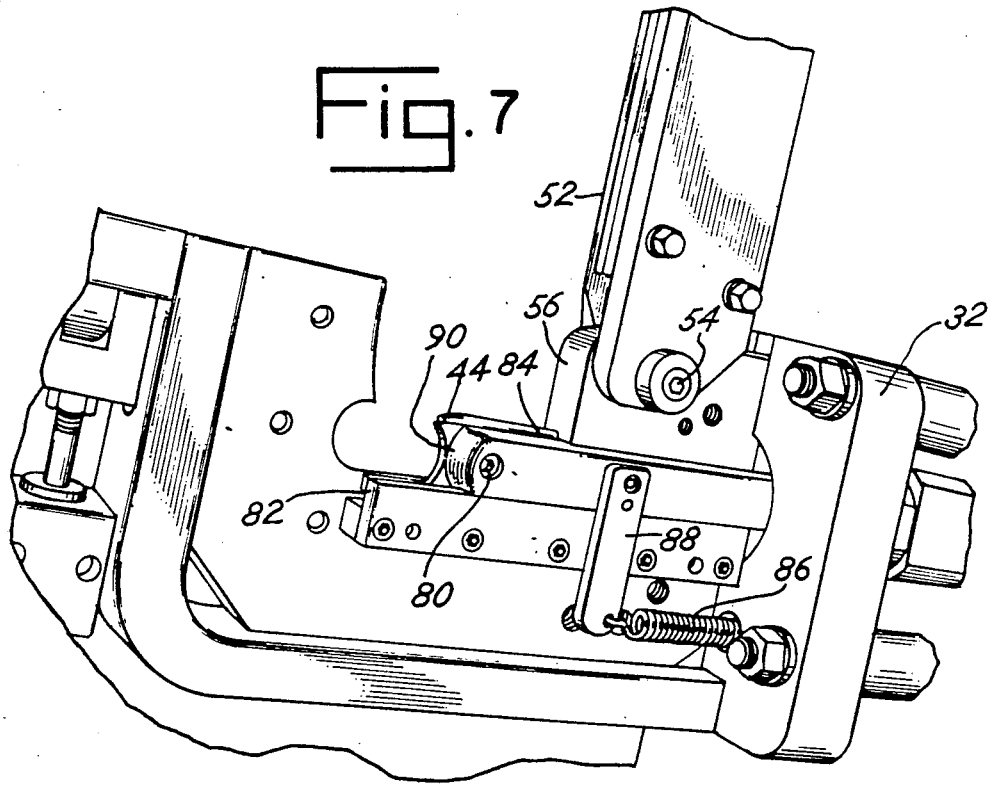
FIG. 7 is a bottom perspective view of the mechanism depicted in FIG. 4 illustrating the position of the gathering bar.

Referring to FIG. 7 an elongated gathering bar 80 is mounted in slots in plate 36 parallel to the sides of the channel 40 in the plate 36. The gathering bar 80 thus slides in slots 82 and 84 as illustrated in FIG. 7 parallel to the punch 44. The gathering bar 80 projects through the plate 32 an is cooperatively engaged by the end of the punch holder. Bar 80 thus can be driven toward the die 46 by the drive rod 48. A spiral spring 86 is attached to an arm 88 affixed to bar 80. The opposite end of the spring 865 is attached to plate 30. The gathering bar 80 is thus biased away from the die 46 by operation of the spring 86.

The gathering bar 80 is slightly fore shortened relative to the punch 44. However, the gathering bar is designed to received gathering insert 90 at its extreme end. The gathering insert 90 can be shaped in any of a number ways depending upon the material which is being clipped and other factors. The gathering insert 90 may extend beyond the end of the punch 44 or may be foreshortened relative to the punch 44 again depending upon empirical needs. In any event, the gathering bar 80 is driven simultaneously with the punch 44 by operation of the rod 48. The gathering bar 80 and more particularly the insert 90 associated therewith engages the material which is to be clipped and which is within the open throat defined by the opening 56 to gather that material and prevent shearing of material when the clip 42 is being attached thereto by operation of the punch 44. The construction of the bar 80 is an important feature of the invention inasmuch as failure to provide means for gathering the material often results in shearing or tearing of the material which is being clipped.

Figure 4:
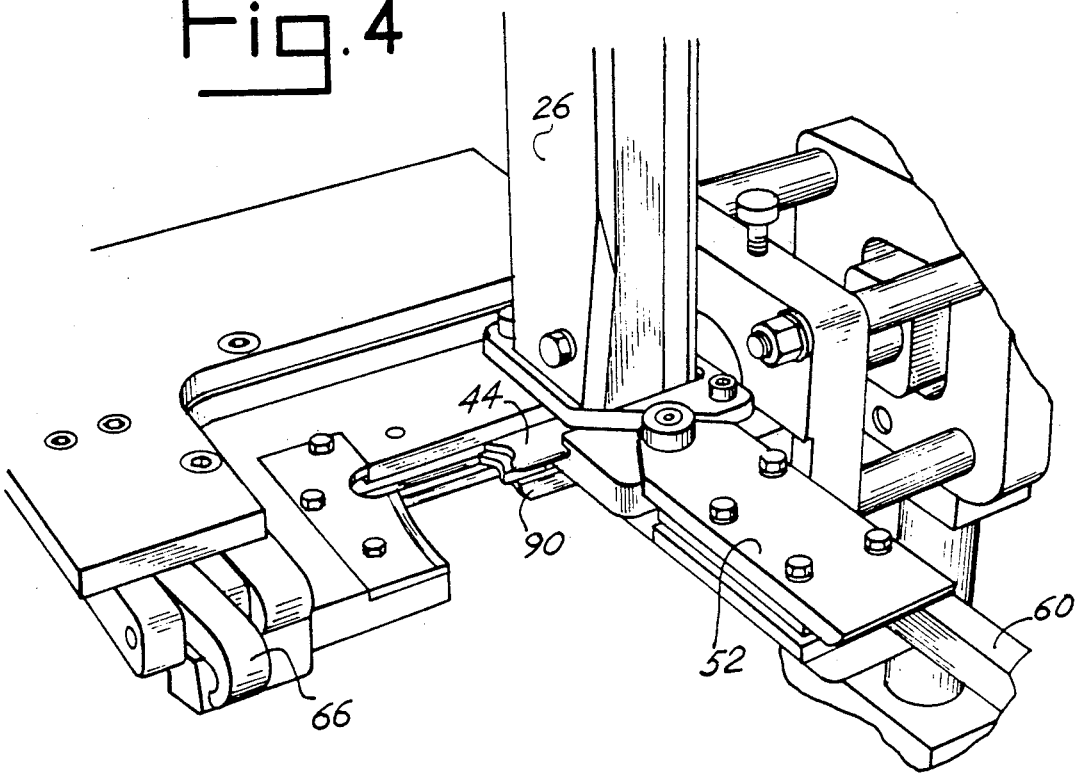
FIG. 4 is a perspective view of the gate and punch mechanism of the clipper.
Figure 5:
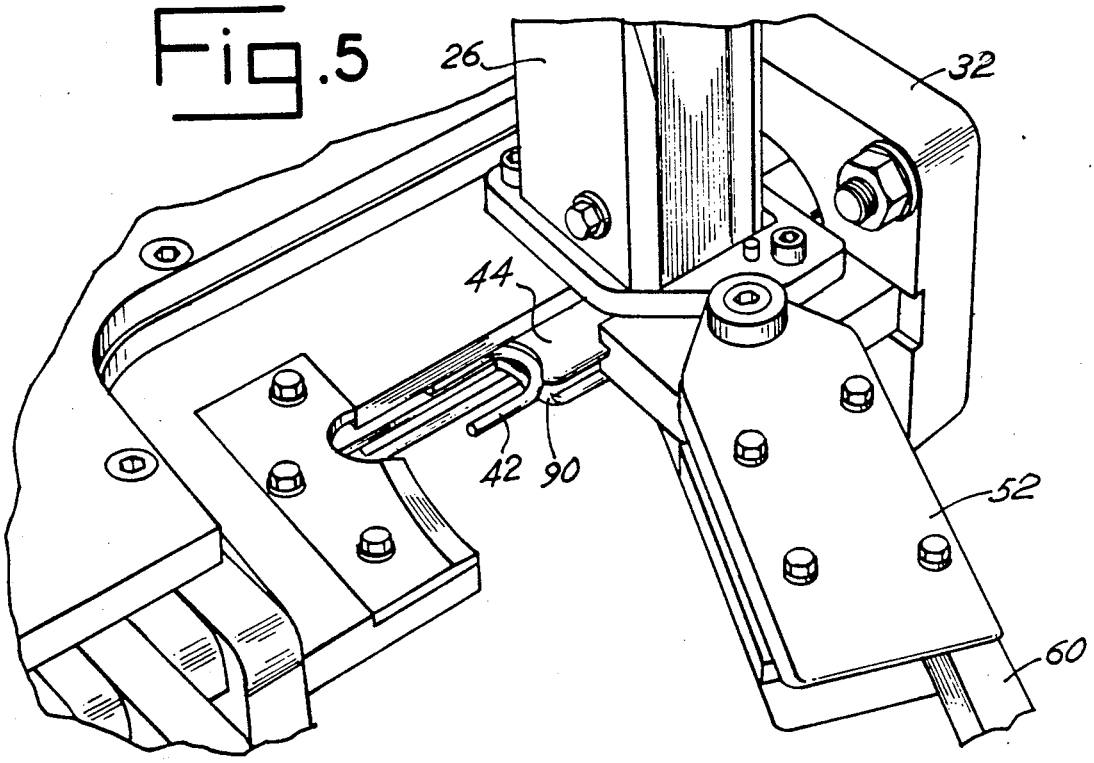
FIG. 5 is a perspective view of the gate and punch mechanism similar to FIG. 4 with the gate partially closed.
Figure 6:
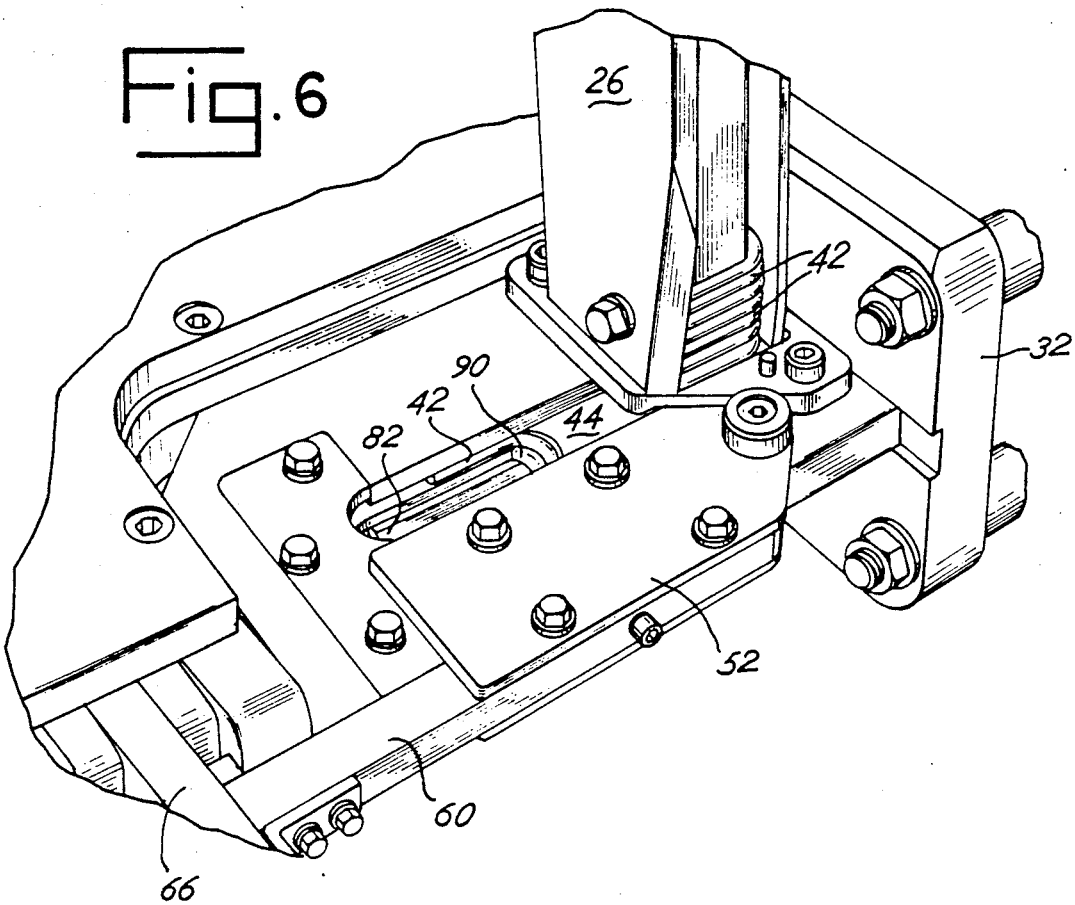
FIG. 6 is a perspective view of the mechanism of FIGS. 4 and 5 with the gate in the closed position.

The operation of the device is illustrated by the sequential FIGS. 4, 5 and 6. As shown in FIG. 4 the gate 52 is in the open position. An operator with his left hand can place a bag of material and more particularly the portion of the bag which is to be clipped in the opening 56. The operator then, with his right hand, will grasp the handle 62 protected by the shield 64 and pivot to gate 52 to the closed position. FIG. 6 illustrates the gate 52 in a final closed position. When in this position the hook 66 can be actuated by operation of the thumb valve 74 and foot treadle valve 75. Pressing the foot treadle 75 and maintaining the thumb switch 74 in the depressed position will drive punch 44 and thus clip 42 down the channel 40 against the die 46.

The gathering bar 80 and more particularly the gathering insert 90 is driven toward the die 46 ahead of the clip 42 and punch 44 so as to compress the package material and shape the rope section of the package material to prevent cutting of the package material during forming of the clip. Once the package material is compressed and ready for the clip to be formed about the rope the gathering bar 80 stops its movement toward die 46 while punch 44 and clip 42 continue to advance toward die 46 until the clip is formed about the package material. Movement of the punch 44 and clip 42 is limited by the hydraulic pressure applied to cylinder 24 by a hydraulic pressure switch which measures the hydraulic pressure at the blind end of cylinder 24. When the preset pressure is reached, the circuit is reset to the starting point. Overtravel of the punch is prevented by the crimp stop 50.

The gathering bar 80 and more particularly the gathering insert 90 will be simultaneously driven against the gathered material. The clip 42 will then be formed about the gathered material. After a clip is formed about the gathered material the hydraulic cylinder 24 reverses operation causing the punch 44 to withdraw. The gathering bar 80 simultaneously withdraws by operation of the spring 86. The thumb switch 74 and treadle switch 75 are released thereby releasing the hook 66. The gate 52 may then manually swing open permitting removal of the clipped material.

With the structure of the present invention, a single large clip, wherein the legs of the clip are spaced one inch or more, can be easily placed about the gathered material in a way which will avoid tearing of the material. Moreover, the gathering bar and punch construction as described enable use of but a single clip to effect appropriate sealing of the gathered material, thereby saving time with respect to prior art constructions requiring multiple sealing means. The use of the handle construction thumb switch 74 and foot treadle 75 provide enhanced safety. The use of various shapes and sizes of inserts 90 which are determined on empirical basis enhances the application characteristics of the clip about the gathered material. It is possible to vary the construction and remain within the scope of the claims. The invention is therefore to be limited only by the following claims and their equivalents.

What is claimed is:

1. An improved, heavy duty clipper comprising in combination:

a support stand for the clipper;

a carriage mounted on the stand with a punch drive cylinder supported by the carriage, said punch drive cylinder having a piston and an extendible drive rod;

said carriage defining a channel for receipt of a U-shaped metal clip, said carriage supporting a die at the end of the channel for deforming the legs of the U-shaped metal clip as a closure, and also defining an open throat for receipt of material for application of a clip as a closure, a pivotal gate attached to the carriage and pivotal between a throat open position and a throat closed position, said gate pivotally attached to the carriage on the side of the open throat opposite the die and including a manual handle for manipulation of the gate extending radially from the pivot connection the carriage, said gate including a portion of the channel when in the closed position, a gate locking hook mechanism supported on the carriage adjacent the die cooperative to engage and retain the gate in the closed position;

means for feeding a clip into the channel;

a punch attached to the drive rod, and slidable in the channel to engage a clip against die; and an elongated gathering bar slidably mounted on the carriage in a channel parallel to the punch, said gathering bar cooperative with the drive rod for movement simultaneous with the punch toward the die for engaging a filled package intermediate the package contents and a clip to be attached thereto and defining means for prevention of tearing of the package as a clip is attached.

2. The improved clipper of claim 1 wherein the gate locking hook comprises a pivotal hook, member pivotal about an axis generally parallel to the direction of punch travel.

3. The improved clipper of claim 1 wherein the gate locking hook is actuated by a first manually responsive control means and the punch drive cylinder is manually actuated by second dependent control means.

4. The improved clipper of claim 1 wherein the gathering bar comprises an elongated bar having a package engaging end defining shaped means for engaging a package.

5. The improved clipper of claim 4 wherein the gathering bar includes a replaceable package engaging end.

6. The improved clipper of claim 1 including biasing means for biasing the gathering bar away from the die.

7. The improved clipper of claim 1 including a stop member on the carriage to limit travel of the punch and gathering bar toward the die.

8. The improved clipper of claim 1 wherein the punch drive cylinder is a hydraulic cylinder.

* * * * *